US010164390B2

(12) United States Patent
Zhang

(10) Patent No.: US 10,164,390 B2
(45) Date of Patent: Dec. 25, 2018

(54) CONNECTING TERMINAL FREE OF DARK SPOTS FOR A LIGHT STRIP AND A LIGHT USING THE SAME

(71) Applicant: GUANGDONG OML TECHNOLOGY CO., LTD., Zhongshan (CN)

(72) Inventor: Peiliang Zhang, Zhongshan (CN)

(73) Assignee: GUANGDONG OML TECHNOLOGY CO. LTD., Zhongshan (CN)

( * ) Notice: Subject to any disclaimer, the term of this patent is extended or adjusted under 35 U.S.C. 154(b) by 107 days.

(21) Appl. No.: 15/322,276

(22) PCT Filed: Oct. 26, 2016

(86) PCT No.: PCT/CN2016/103320

§ 371 (c)(1),
(2) Date: Dec. 27, 2016

(87) PCT Pub. No.: WO2018/072225

PCT Pub. Date: Apr. 26, 2018

(65) Prior Publication Data

US 2018/0219339 A1 Aug. 2, 2018

(30) Foreign Application Priority Data

Oct. 17, 2016 (CN) ..... 2016 1 0905197

(51) Int. Cl.
*H01R 31/06* (2006.01)
*F21S 4/20* (2016.01)
(Continued)

(52) U.S. Cl.
CPC ..... *H01R 31/06* (2013.01); *F21S 4/20* (2016.01); *F21V 23/06* (2013.01);
(Continued)

(58) Field of Classification Search
CPC ..... H01R 31/06; H01R 31/512; H01R 13/04; F21S 4/20; F21V 23/06; F21Y 2103/00
(Continued)

(56) References Cited

U.S. PATENT DOCUMENTS 4,607,317 A * 8/1986 Lin ..... F21V 23/06 362/122
8,545,045 B2 * 10/2013 Tress ..... F21V 33/0012 315/185 R (Continued)

*Primary Examiner* — Laura Tso
(74) *Attorney, Agent, or Firm* — R. Neil Sudol; Henry D. Coleman

(57) ABSTRACT

A connecting terminal free of dark spots for a light strip, comprising a bracket, wherein the bracket is fixedly provided with two pin groups, each pin group comprises at least two pins, the pins in each pin group are in communication with each other, the pin is made of a conducting material; a light using the connecting terminal free of dark spots for light strip comprises a plurality of light strips and said connecting terminal, the light strip are provided with two connecting jacks at both ends thereof, each connecting jack is connected with one of the pins in each corresponding pin group. The connecting terminal employing the above structure is convenient and rapid; thus realizing the connection free of dark spots of the light strip. The installation is also very convenient. Therefore, the structure is simple and useful, with remarkable technical effects.

9 Claims, 12 Drawing Sheets

(51) Int. Cl.

| | |
|---|---|
| ***F21V 23/06*** | (2006.01) |
| *F21Y 103/00* | (2016.01) |
| *H01R 13/04* | (2006.01) |
| *H01R 13/512* | (2006.01) |

(52) U.S. Cl.
CPC ..... *F21Y 2103/00* (2013.01); *H01R 13/04* (2013.01); *H01R 13/512* (2013.01)

(58) Field of Classification Search
USPC ..... 362/219, 652, 657, 658, 659, 647; 439/655
See application file for complete search history.

(56) References Cited

U.S. PATENT DOCUMENTS

| | | | | |
|---|---|---|---|---|
| 2008/0094828 | A1* | 4/2008 | Shao | F21K 9/00 362/219 |
| 2015/0024637 | A1* | 1/2015 | Osada | H01R 13/42 439/655 |
| 2015/0338068 | A1* | 11/2015 | Bolscher | F21V 21/005 362/219 |
| 2016/0116143 | A1* | 4/2016 | Li | F21V 15/015 362/219 |

* cited by examiner

CONNECTING TERMINAL FREE OF DARK SPOTS FOR A LIGHT STRIP AND A LIGHT USING THE SAME

FIELD OF THE INVENTION

The present invention relates to a connecting terminal free of dark spots for a light strip and a light using the same.

BACKGROUND OF THE INVENTION

A light strip is a commonly used ornament. When being used for decoration, the light strip are connected and placed according to a set pattern, and the light strips are connected with each other via a connecting terminal. Although the existing connecting terminal may play a role in connecting the light strips, it still has lots of defects. For example, there may be dark spots occurring in the connecting terminal, resulting in defects of the overall effect of the light strip; moreover, the process is complicated when connecting the existing connecting terminal with the light strip, so that it is inconvenient to assemble rapidly, and so on. Therefore, the present invention provides a connecting terminal free of dark spots for a light strip and a light using the same.

SUMMARY OF THE INVENTION

In order to solve the above-mentioned problems, the present invention provides a connecting terminal free of dark spots for a light strip and a light using the same.

In order to solve the technical problems, the present invention employs a technical solution as follows:

A connecting terminal free of dark spots for a light strip, comprising a bracket, wherein the bracket is fixedly provided with two pin groups, each pin group includes at least two pins, the pins in each pin group are in communication with each other, and the pin is made of a conducting material.

A connecting terminal in accordance with the present invention further includes a housing, wherein the housing is provided with at least one channel, each channel is at least provided with two exits, the bracket is arranged in the channel, and part of or the whole side wall of the channel is permeable to light.

Pursuant to further features of the present invention, each channel is provided with two exits, the channel is in a straight slotted shape, the bracket includes a first vertical plate, the first vertical plate is arranged in the channel, each pin group includes two pins located at respective sides of the first vertical plate respectively, and two pins are connected by passing through the first vertical plate.

Pursuant to other features of the present invention, each channel is provided with two exits, the channel is L-shaped, the bracket includes a flat plate, the flat plate is arranged in the channel, and located at a corner of the channel, each pin group includes two pins facing towards the two exits respectively, the pins are fixed in the flat plate, and the pins in the same pin group are in communication with each other in the flat plate.

Pursuant to additional features of the present invention, the flat plate is provided with two projections at the upper end thereof, and a junction of the pin and the flat plate is located on a side wall of the projection.

According to further features of the present invention, each channel is provided with three exits, the channel is T-shaped, the bracket includes a second vertical plate and a third vertical plate, both sides of the second vertical plates face towards two exits respectively, one side of the third vertical plate faces towards the other exit, while the other side thereof is connected with the second vertical plate, each pin group includes three pins, the three pins are located at two sides of the second vertical plate and at the side of the third vertical plate facing towards the exit respectively, and the pins in the same pin group are in communication with each other inside the second vertical plate and the third vertical plate.

According to more features of the present invention, a lower end of the second vertical plate and a lower end of the third vertical plate are fixed in a pedestal, the pedestal is fixedly connected with the side wall of the channel, and the pins in the same pin group are in communication with each other inside the second vertical plate, the third vertical plate and the pedestal.

Accordingly to another feature of the invention, the pin is provided with a plurality of annular tapered convex rings on the external side wall thereof.

Pursuant to the present invention, a light using the above-mentioned connecting terminal free of dark spots for a light strip includes a plurality of light strips and the connecting terminal free of dark spots for light strip, wherein the light strips are each provided with two connecting jacks at respective ends thereof, one connecting jack is connected with the pins in one pin group, while the other connecting jack is connected with the pins in the other pin group.

A sealant may be provided between an end portion of the light strip and the bracket.

The present invention has advantageous effects that: through fixing two pin groups in the bracket, the connecting terminal employing the above structure is butted against the light strip through the pin groups. The connection is convenient and rapid; at the same time, no dark spots are formed in the bracket, thus realizing the connection free of dark spots of the light strip. The installation is also very convenient. Therefore, the structure is simple and useful, with remarkable technical effects.

BRIEF DESCRIPTION OF DRAWINGS

The present invention will be further described in details with reference to the drawings and the specific embodiments hereinafter, in which.

DETAILED DESCRIPTION OF THE EMBODIMENTS

Figure 1:
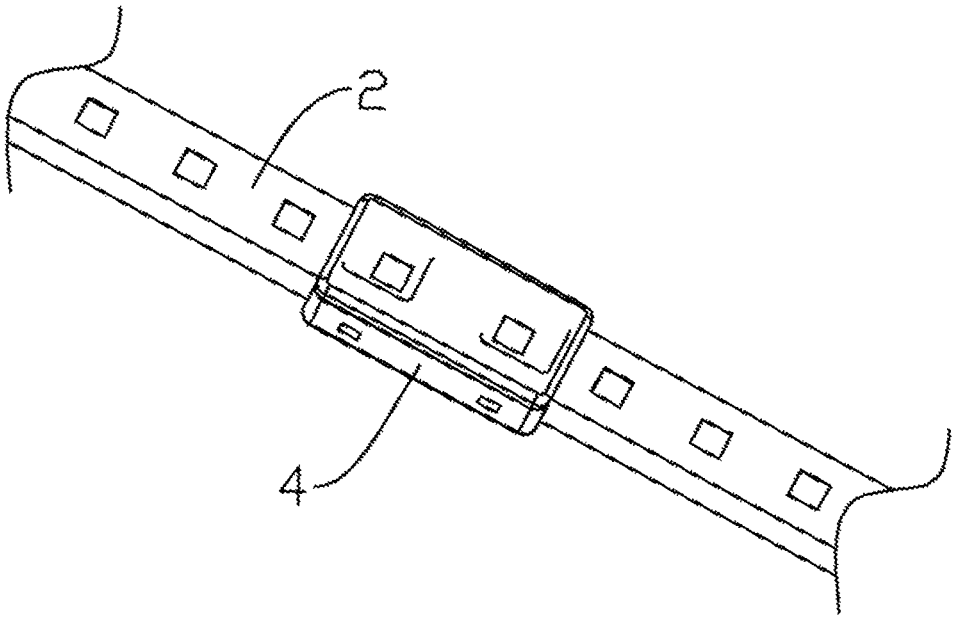
FIG. 1 is a schematic diagram I of a first embodiment of the present invention.

With reference to FIG. 1 to FIG. 12, a connecting terminal free of dark spots for a light strip 2, includes a bracket, wherein the bracket is made of an insulating material, two pin groups are fixed in the bracket, each pin group includes at least two pins 1, the pins 1 in each pin group are in communication with each other, the pin 1 is made of a conducting material, the pin 1 and the bracket are manufactured in a form of overall injection molding, and the bracket may be made very thin, so that the light emitted from the light strips 2 at both ends can fully cross the bracket area, without producing relatively dark spots; the pin 1 is provided with a plurality of annular tapered convex rings 3 on the external side wall thereof, so that the connection strength of the pin 1 and the light strip 2 may be enhanced.

Figure 2:
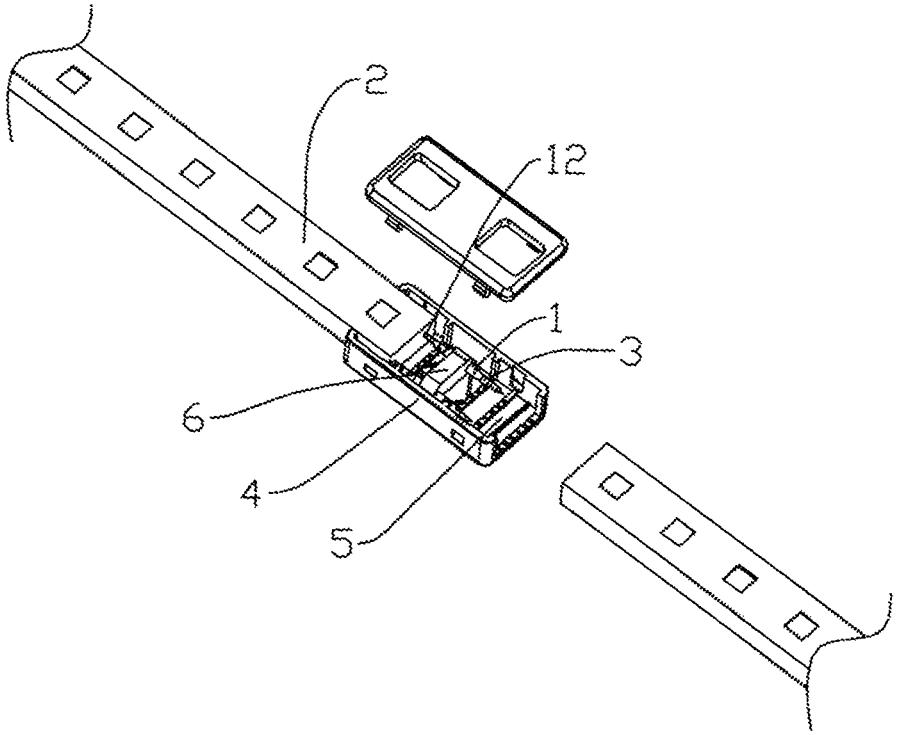
FIG. 2 is a exploded schematic diagram I of the first embodiment of the present invention.
Figure 3:
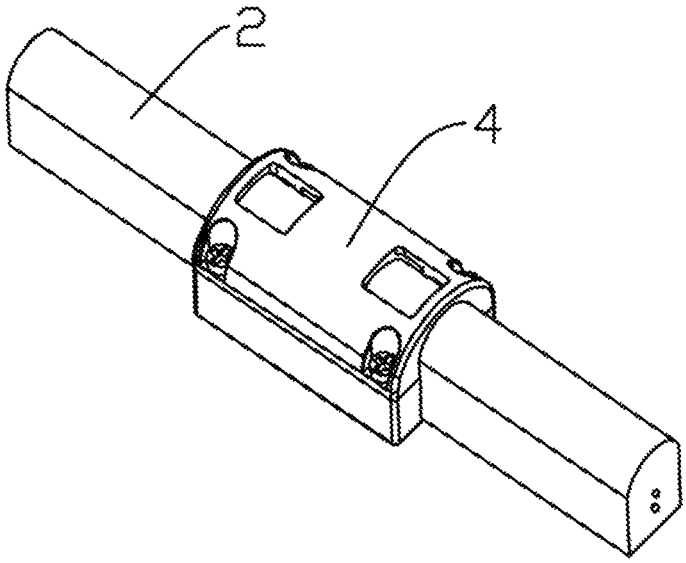
FIG. 3 is a schematic diagram II of the first embodiment of the present invention.
Figure 4:
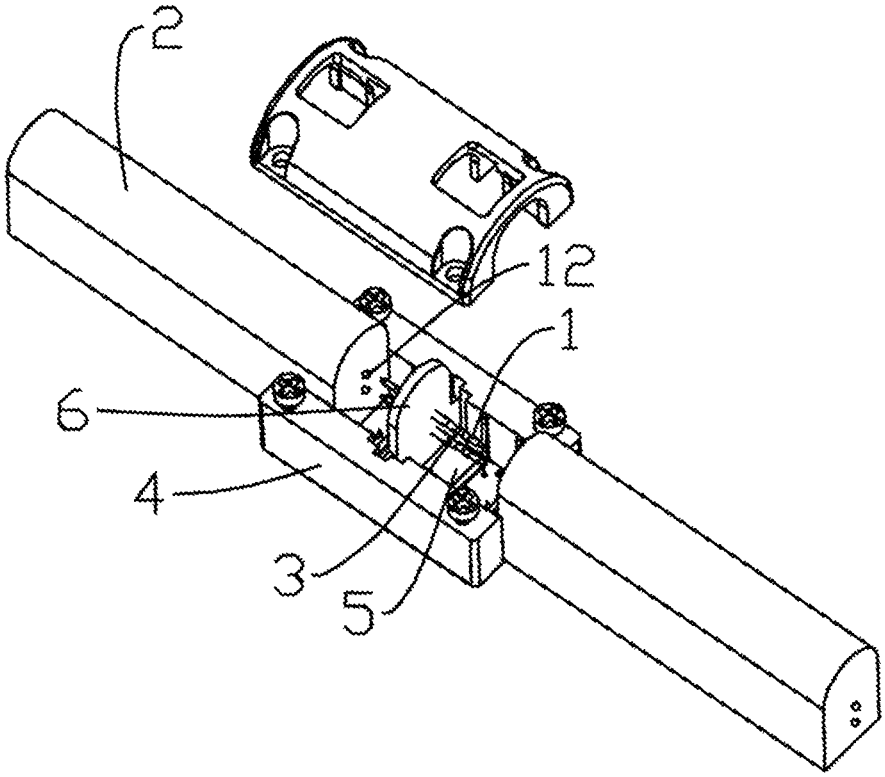
FIG. 4 is a exploded schematic diagram II of the first embodiment of the present invention.

The illustrated connecting terminal of the present invention further includes a housing 4, wherein the housing 4 is provided with at least one channel 5, each channel 5 is at least provided with two exits, the bracket is arranged in the channel 5, and part of or the whole side wall of the channel 5 is permeable to light. FIG. 1, FIG. 2, FIG. 3 and FIG. 4 illustrate a first embodiment of the connecting terminal free of dark spots for the light strip 2. In this embodiment, each channel 5 is provided with two exits, the channel 5 is in a straight slotted shape, the bracket includes a first vertical plate 6, the first vertical plate 6 is arranged in the channel 5, each pin group includes two pins 1 located at respective sides of the first vertical plate 6, the two pins 1 are connected by passing through the first vertical plate 6, the channel 5 is preferably arranged overall permeable to light, so that loss of lighting effect may be reduced and the dark spots may be eliminated; the two pin groups illustrated in FIGS. 3 and 4 are vertically distributed, and the two pin groups illustrated in FIGS. 1 and 2 are horizontally distributed.

By fixing two pin groups in the bracket, the connecting terminal employing the above structure is butted against the light strip 2 through the pin groups. Such connection is convenient and rapid; at the same time, no dark spots are formed in the bracket, thus realizing a connection free of dark spots with the light strip 2. The installation is also very convenient. Therefore, the structure is simple and useful, with remarkable technical effects.

Figure 5:
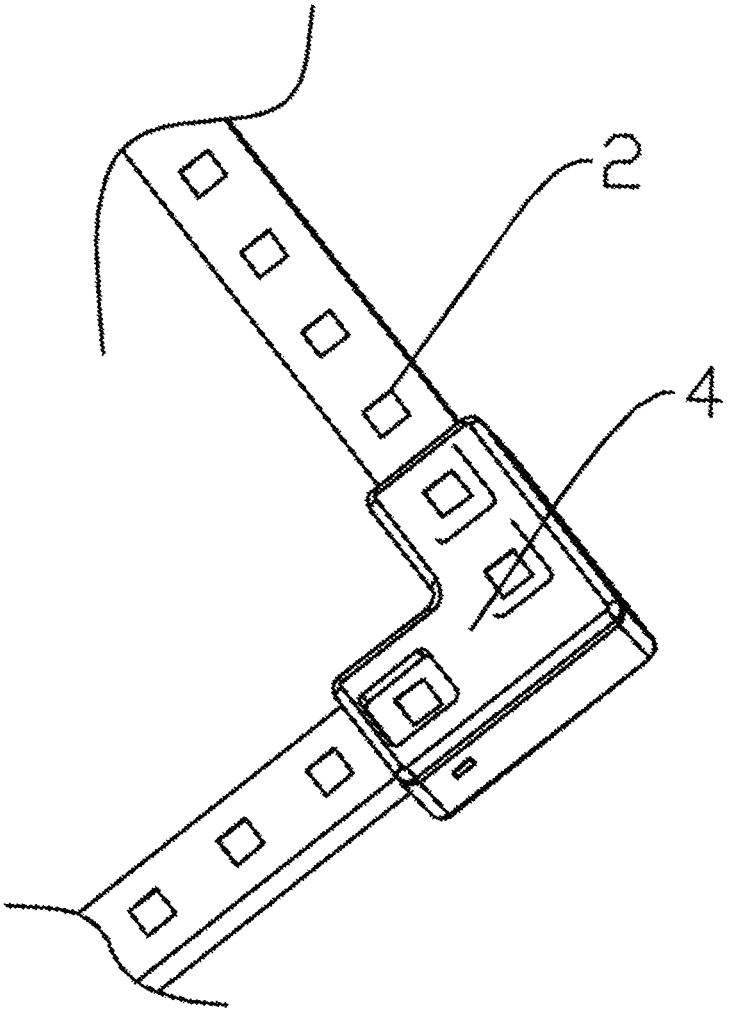
FIG. 5 is a schematic diagram of a second embodiment of the present invention.
Figure 6:
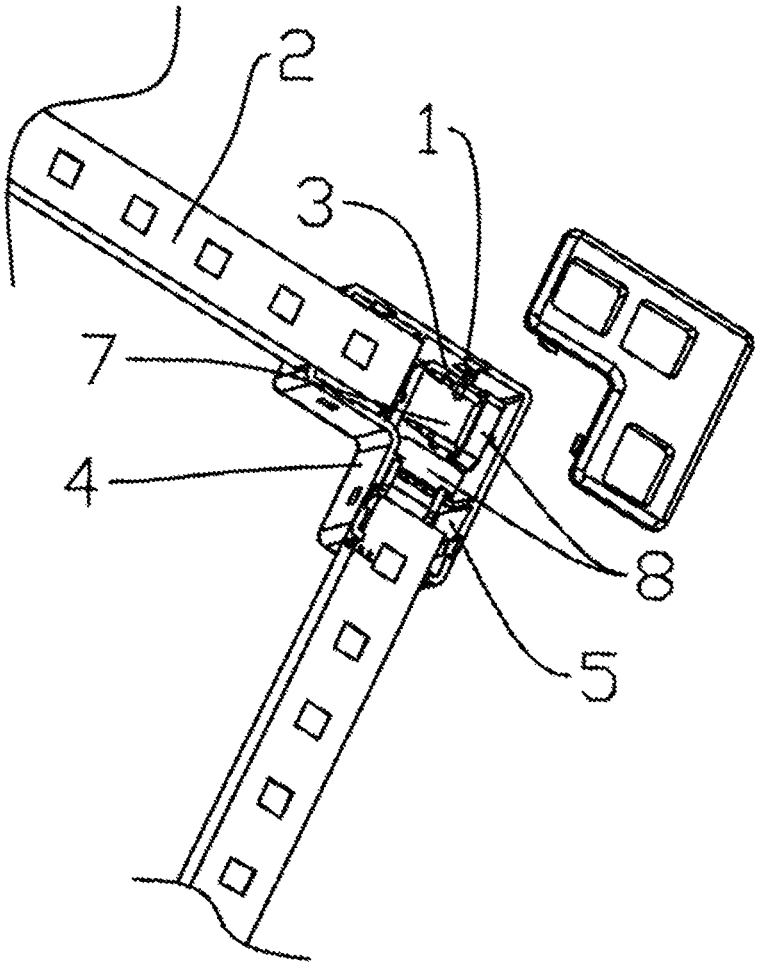
FIG. 6 is a exploded schematic diagram of the second embodiment of the present invention.

FIG. 5 and FIG. 6 illustrate a second embodiment of the connecting terminal free of dark spots for the light strip 2, which is generally the same as the first embodiment, but with a difference that: each channel 5 is provided with two exits, the channel is L-shaped, the bracket includes a flat plate 7, the flat plate is arranged in the channel 5, and located at a corner of the channel 5, each pin group includes two pins 1 facing towards two exits respectively, the pins 1 are fixed on the flat plate 7, the pins 1 in the same pin group are in communication with each other inside the flat plate 7; the flat plate 7 is provided with two projections 8 at the upper end thereof, a junction of the pin 1 and the flat plate 7 is located on a side wall of the projection 8, the projection 8 may be arranged to increase the stability of the pin 1 and reduce the deformation of the pin 1, the two pin groups in the embodiment are horizontally distributed, and the two pins 1 in the same pin group are perpendicular to each other, so that two pins 1 in the same pin group need to pass through the projection 8 to be in communication with each other inside the flat plate 7; and the second embodiment is applicable to connecting the two light strips 2 perpendicular to each other, bringing about the same technical effect as that of the first embodiment.

Figure 7:
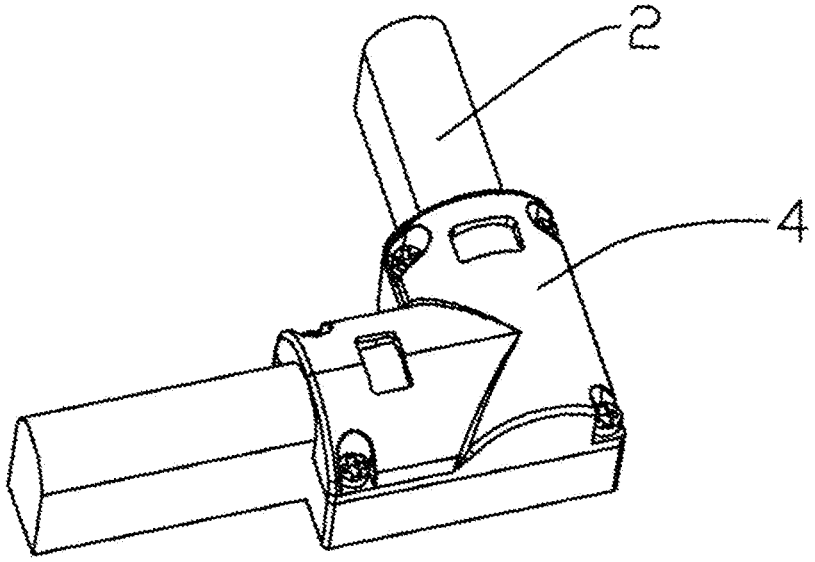
FIG. 7 is a schematic diagram of a third embodiment of the present invention.
Figure 8:
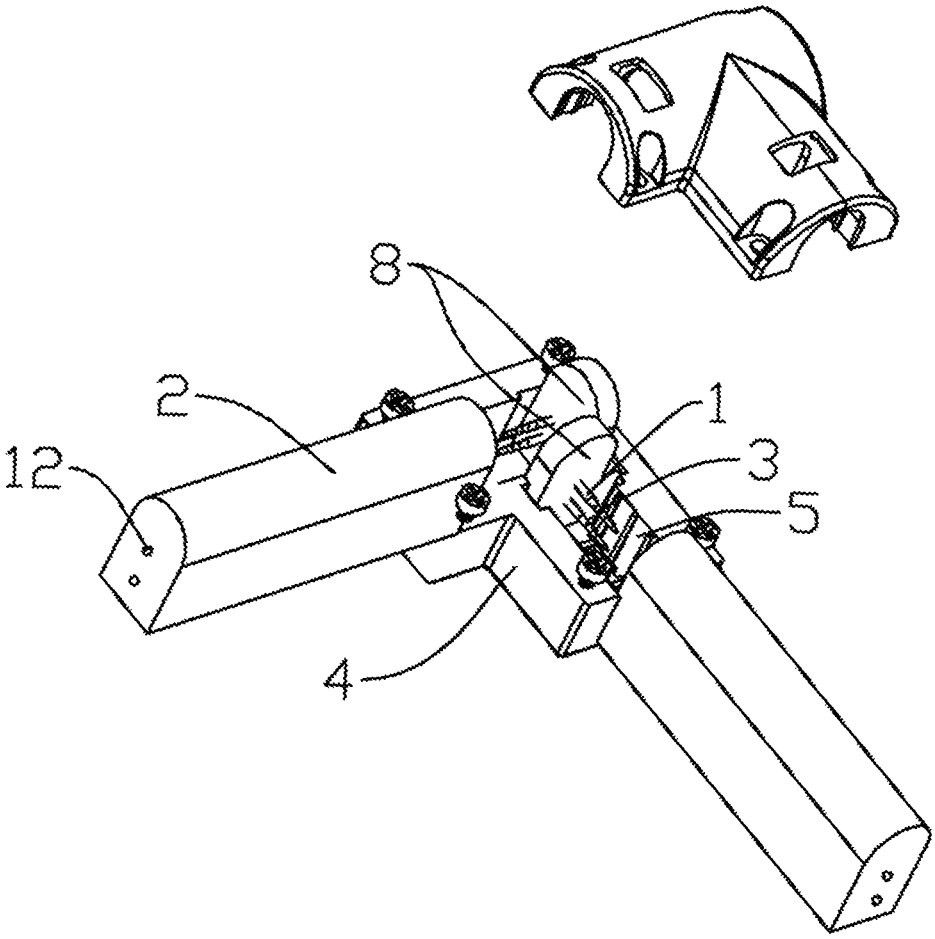
FIG. 8 is a exploded schematic diagram of the third embodiment of the present invention.

FIG. 7 and FIG. 8 illustrate a third embodiment of the connecting terminal free of dark spots for the light strip 2, which is generally the same as the second embodiment, but with a difference that two pin groups are vertically distributed, so that two pins 1 in the same pin group are directly in communication with each other inside the projection 8, the flat plate 7 is omitted, and the projection 8 is directly installed in the channel 5. The third embodiment is applicable to connecting two light strips 2 perpendicular to each other, bringing about the same technical effect as that of the first embodiment.

Figure 9:
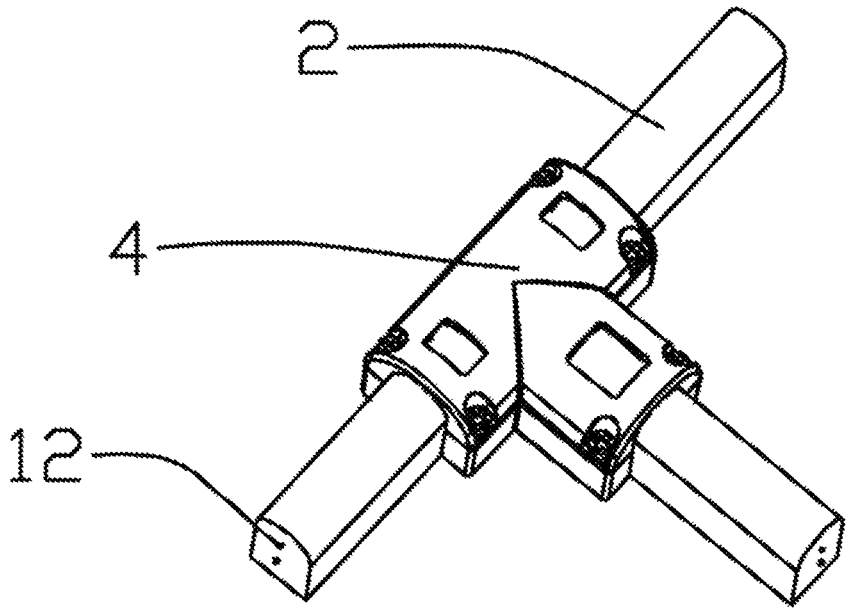
FIG. 9 is a schematic diagram of a fourth embodiment of the present invention.
Figure 10:
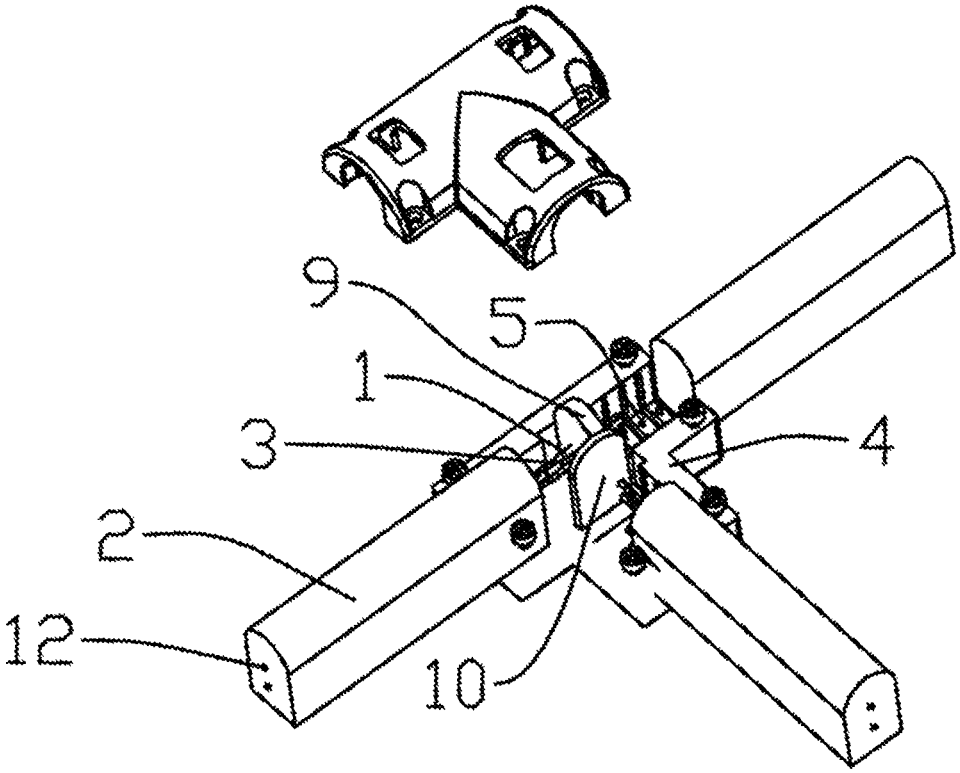
FIG. 10 is a exploded schematic diagram of the fourth embodiment of the present invention.

FIG. 9 and FIG. 10 illustrate a fourth embodiment of the connecting terminal free of dark spots for the light strip 2, which is generally the same as the first embodiment, but with a difference that: each channel 5 is provided with three exits, the channel 5 is T-shaped, the bracket includes a second vertical plate 9 and a third vertical plate 10, both sides of the second vertical plate 9 face towards two exits respectively, one side of the third vertical plate 10 faces towards the other exit, while the other side thereof is connected with the second vertical plate 9, each pin group includes three pins 1 located at both sides of the second vertical plate 9 and the side of the third vertical plate 10 facing towards the exit respectively, two pin groups are vertically distributed, the pins 1 of the same pin group are in communication with each other inside the second vertical plate 9 and the third vertical plate 10; and the fourth embodiment is applicable to connecting three sections of light strips 2, bringing about the same technical effect as that of the first embodiment.

Figure 11:
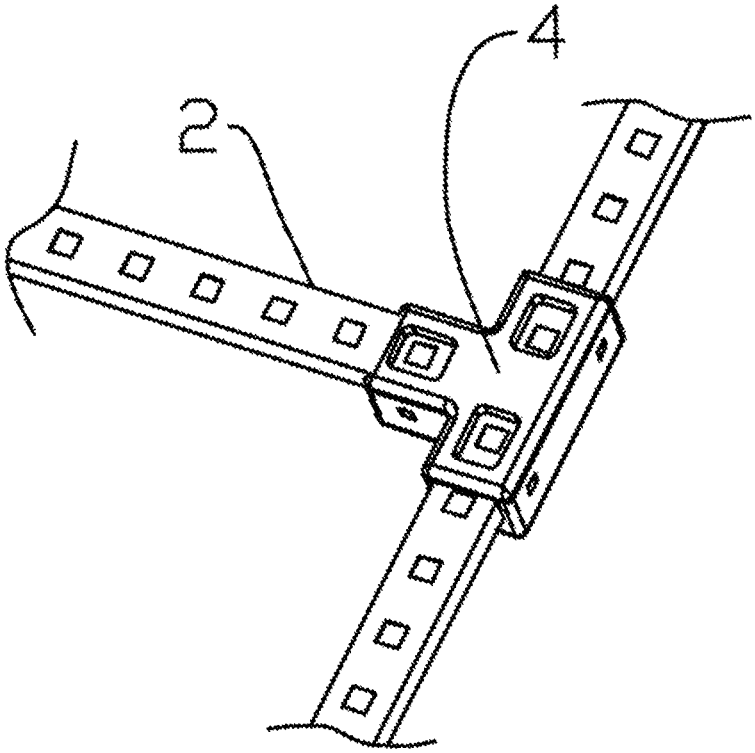
FIG. 11 is a schematic diagram of a fifth embodiment of the present invention.
Figure 12:
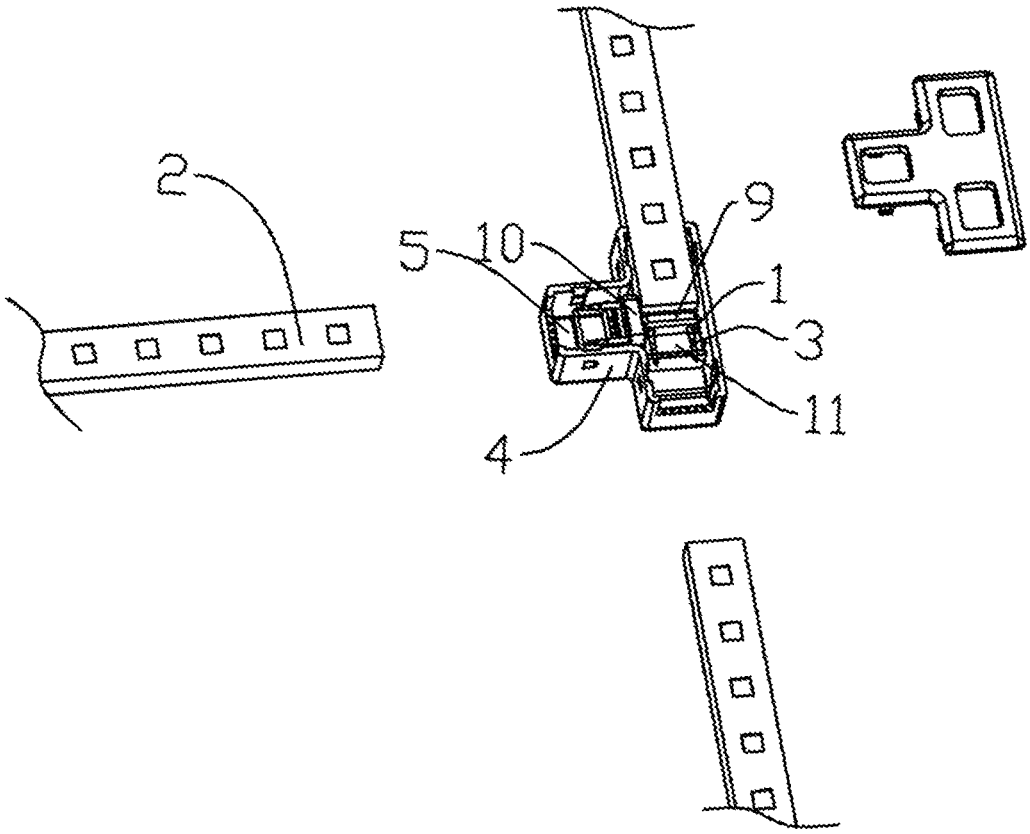
FIG. 12 is a exploded schematic diagram of the fifth embodiment of the present invention.

FIG. 11 and FIG. 12 illustrate a fifth embodiment of the connecting terminal free of dark spots for the light strip 2, which is generally the same as the fourth embodiment, but with a difference that a lower end of the second vertical plate 9 and a lower end of the third vertical plate 10 are fixed on a pedestal 11, the pedestal 11 is fixedly connected with the side wall of the channel 5, and the pins 1 of the same pin group are in communication with each other inside the second vertical 9, the third vertical plate 10 and the pedestal 11. The two pin groups are horizontally distributed, the pedestal 11 is arranged so that the pins 1 of the same pin group are communicated with each other in the pedestal 11; and the fifth embodiment is applicable to connecting three sections of light strips 2, bringing about the same technical effect as that of the first embodiment.

FIG. 1 to FIG. 12 illustrate a light using the above-mentioned connecting terminal free of dark spots for the light strip 2, including a plurality of light strips 2 and the above-mentioned connecting terminal free of dark spots for light strip 2; the light strip 2 is provided with two connecting jacks 12 at respective ends thereof, one connecting jack 12 is connected with the pins 1 in one pin group, while the other connecting jack 12 is connected with the pins 1 in the other pin group, a sealant is provided between an end portion of the light strip and the bracket, so that a waterproof effect is improved. The light employing this structure is convenient to assemble, lights without dark spots, and has an excellent effect.

The above embodiments are preferred embodiments of the present invention merely, and the present invention may also have other embodiments. Various equivalent transformations or replacement may further be made by those skilled in the art without departing from the present invention and shall all fall within the scope stated by the claims of this application.

The invention claimed is:

1. A connecting terminal free of dark spots for a light strip, comprising:

a bracket, wherein the bracket is fixedly provided with two pin groups, each pin group comprises at least two pins, the pins in each pin group are in communication with each other, and the pin is made of a conducting material; and a housing, wherein the housing is provided with at least one channel, each channel is at least provided with two exits, the bracket is arranged in the channel, and part of or the whole side wall of the channel is permeable to light.

2. The connecting terminal free of dark spots for a light strip according to claim 1, wherein each channel is provided with two exits, the channel is in a straight slotted shape, the bracket comprises a first vertical plate, the first vertical plate is arranged in the channel, each pin groups comprises two pins located at both sides of the first vertical plate respectively, and two pins are connected by passing through the first vertical plate.

3. The connecting terminal free of dark spots for a light strip according to claim 1, wherein each channel is provided with two exits, the channel is L-shaped, the bracket comprises a flat plate, the flat plate is arranged in the channel, and located at a corner of the channel, each pin group comprises two pins facing towards the two exits respectively, the pins are fixed in the flat plate, and the pins in the same pin group are in communication with each other in the flat plate.

4. The connecting terminal free of dark spots for alight strip according to claim 3, wherein the flat plate is provided with two projections at the upper end thereof and a junction of the pin and the flat plate is located on a side wall of the projection.

5. The connecting terminal free of dark spots for a light strip according to claim 1, wherein each channel is provided with three exits, the channel is T-shaped, the bracket comprises a second vertical plate and a third vertical plate, both sides of the second vertical plates face towards two exits respectively, one side of the third vertical plate faces towards another the other exit, while the other side of the third vertical plate thereof is connected with the second vertical plate, each pin group comprises three pins, the three pins are located at two sides of the second vertical plate and at the side of the third vertical plate facing towards the exit respectively, and the pins in the same pin group are in communication with each other inside the second vertical plate and the third vertical plate.

6. The connecting terminal free of dark spots for a light strip according to claim 5, wherein a lower end of the second vertical plate and a lower end of the third vertical plate are fixed in a pedestal, the pedestal is fixedly connected with the side wall of the channel, and the pins in the same pin group are in communication with each other inside the second vertical plate, the third vertical plate and the pedestal.

7. The connecting terminal free of dark spots for a light strip according to claim 1, wherein the pin is provided with a plurality of annular tapered convex rings on the external side wall thereof.

8. A light using the connecting terminal free of dark spots for a light strip according to claim 1, comprising a plurality of light strips and the connecting terminal free of dark spots for the light strip, wherein the light strip are provided with two connecting jacks at both ends thereof, one connecting jack is connected with the pins in one pin group, while the other connecting jack is connected with the pins in the other pin group.

9. The light using the connecting terminal free of dark spots for a light strip according to claim 8, wherein a sealant is filled between an end portion of the light strip and the bracket.

* * * * *